US006328586B1

(12) United States Patent
Lin

(10) Patent No.: US 6,328,586 B1
(45) Date of Patent: Dec. 11, 2001

(54) ZERO INSERTION FORCE CPU CONNECTOR

(76) Inventor: Jui Hsiang Lin, 6F-1, 79, Hang Chou S. Road, Sec. 1, Taipei (TW)

( * ) Notice: Subject to any disclaimer, the term of this patent is extended or adjusted under 35 U.S.C. 154(b) by 0 days.

(21) Appl. No.: 09/643,858

(22) Filed: Aug. 23, 2000

(51) Int. Cl.[7] ..... H01R 4/50
(52) U.S. Cl. ..... 439/342; 439/259
(58) Field of Search ..... 439/342, 259, 439/263, 264

(56) References Cited

U.S. PATENT DOCUMENTS 5,454,727 * 10/1995 Hsu ..... 439/263
5,616,044 * 4/1997 Tsai ..... 439/342
5,649,836 * 7/1997 Kashiwagi ..... 439/342
5,797,774 * 8/1998 Kaneko ..... 439/342
6,074,233 * 6/2000 Lin ..... 439/342
6,099,321 * 8/2000 McHugh et al. ..... 439/342
6,113,411 * 9/2000 Lu et al. ..... 439/342

* cited by examiner

*Primary Examiner*—Gary F. Paumen
(74) *Attorney, Agent, or Firm*—Dougherty & Troxell

(57) ABSTRACT

A zero insertion force CPU connector is constructed to include a connector body, a plurality of terminals installed in respective terminal slots in the connector body, and a sliding cover covered on the connector body and adapted to support a CPU and carry the CPU into contact with the terminals in the connector body, wherein the terminals each have a head formed of a supporting strip, a springy pressure strip, and a space defined between the supporting strip and the springy pressure strip and adapted to receive the pins of the CPU carried on the sliding cover; the sliding cover has a plurality of bottom rods adapted to force the springy pressure strip of each terminal toward the corresponding supporting strip, enabling the pins of the CPU to be respectively positively maintained in contact between the supporting strip and springy pressure strip of each terminal.

5 Claims, 10 Drawing Sheets

ZERO INSERTION FORCE CPU CONNECTOR

BACKGROUND OF THE INVENTION

The present invention relates to relates to CPU connectors, and more particularly to a zero insertion force CPU connector in which each terminal has a head formed of a supporting strip and a springy pressure strip and adapted to receive the pins of the CPU, and the CPU supporting sliding cover has bottom rods adapted to force the springy pressure strip of each terminal toward the respective supporting strip against the pins of the loaded CPU for enabling the pins of the loaded CPU to be respectively maintained in positive contact with the terminals.

A regular CPU connector is generally comprised of a connector body having longitudinally transversely aligned terminal slots, a plurality of terminals respectively installed in the terminals, and a sliding cover covered on the connector body and adapted to hold a CPU and to carry the loaded CPU into contact with the terminals. Because of manufacturing tolerance, the terminals may have different spring power. If the terminals are not accurately installed in the respective terminal slots in the connector body, a contact error may occur after the pins of the CPU have been into the respective insertion holes of the sliding cover and the respective terminal slots of the connector body and the sliding cover has been shifted into position. Further, when shifting the sliding cover into position to give a pressure to the pins of the CPU against the terminals, the pins of the CPU may be damaged.

SUMMARY OF THE INVENTION

The present invention has been accomplished to provide a zero insertion force CPU connector, which eliminates the aforesaid drawbacks. It is one object of the present invention to provide a zero insertion force CPU connector, which produces zero friction resistance upon insertion of the pins of a CPU into the respective insertion holes on the sliding cover and the respective terminal slots in the connector body. It is another object of the present invention to provide a zero insertion force CPU connector, which keeps the pins of the loaded CPU in positive contact with the respective terminals in the connector body. According to the present invention, the terminals each have a head formed of a supporting strip, a springy pressure strip, and a space defined between the supporting strip and the springy pressure strip and adapted to receive the pins of the CPU carried on the sliding cover, and the sliding cover has a plurality of bottom rods adapted to force the springy pressure strip of each terminal toward the corresponding supporting strip, enabling the pins of the CPU to be respectively positively maintained in contact between the supporting strip and springy pressure strip of each terminal.

DETAILED DESCRIPTION OF THE PREFERRED EMBODIMENT

Figure 1:
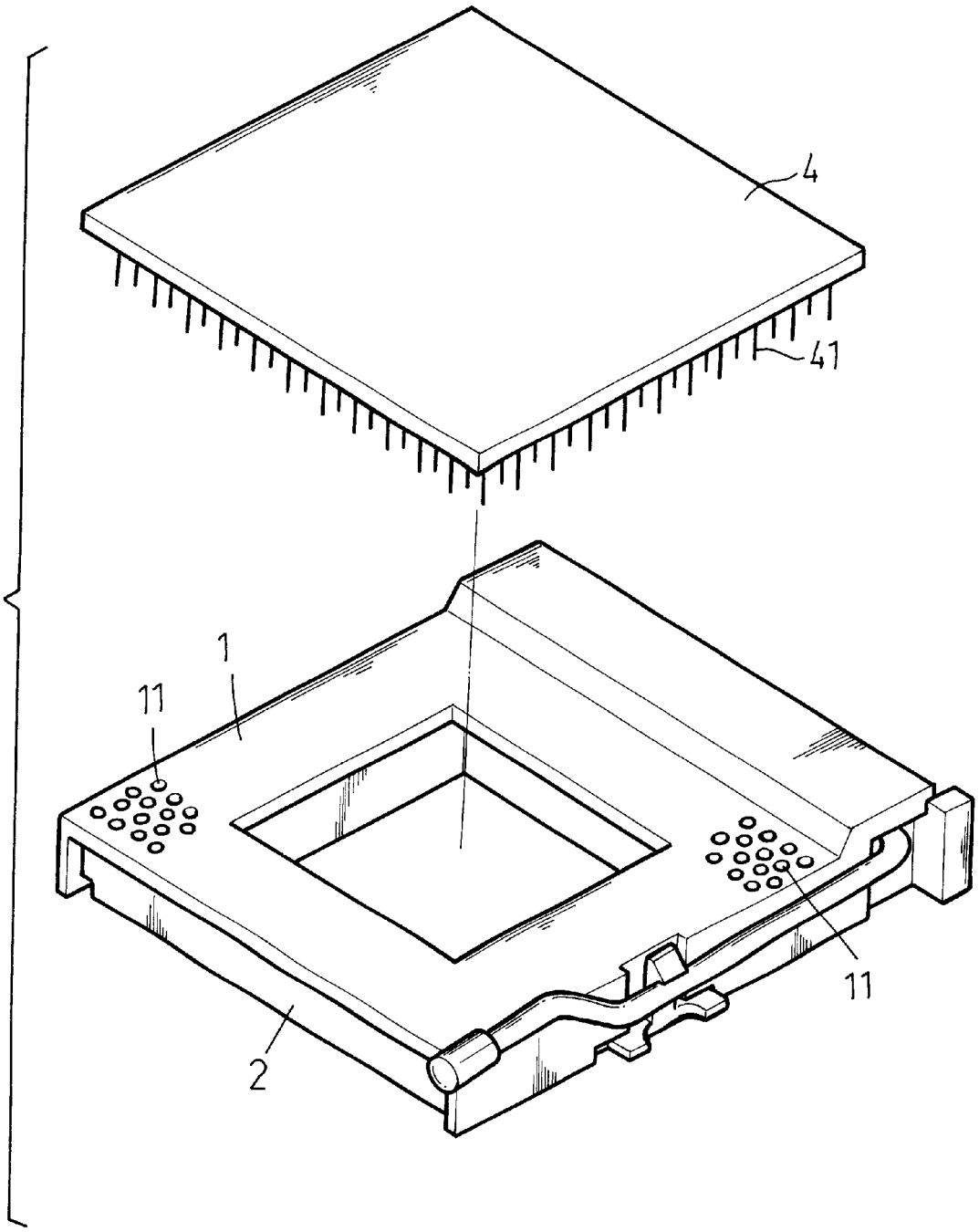
FIG. 1 illustrates the outer appearance of a CPU connector according to the present invention.
Figure 2:
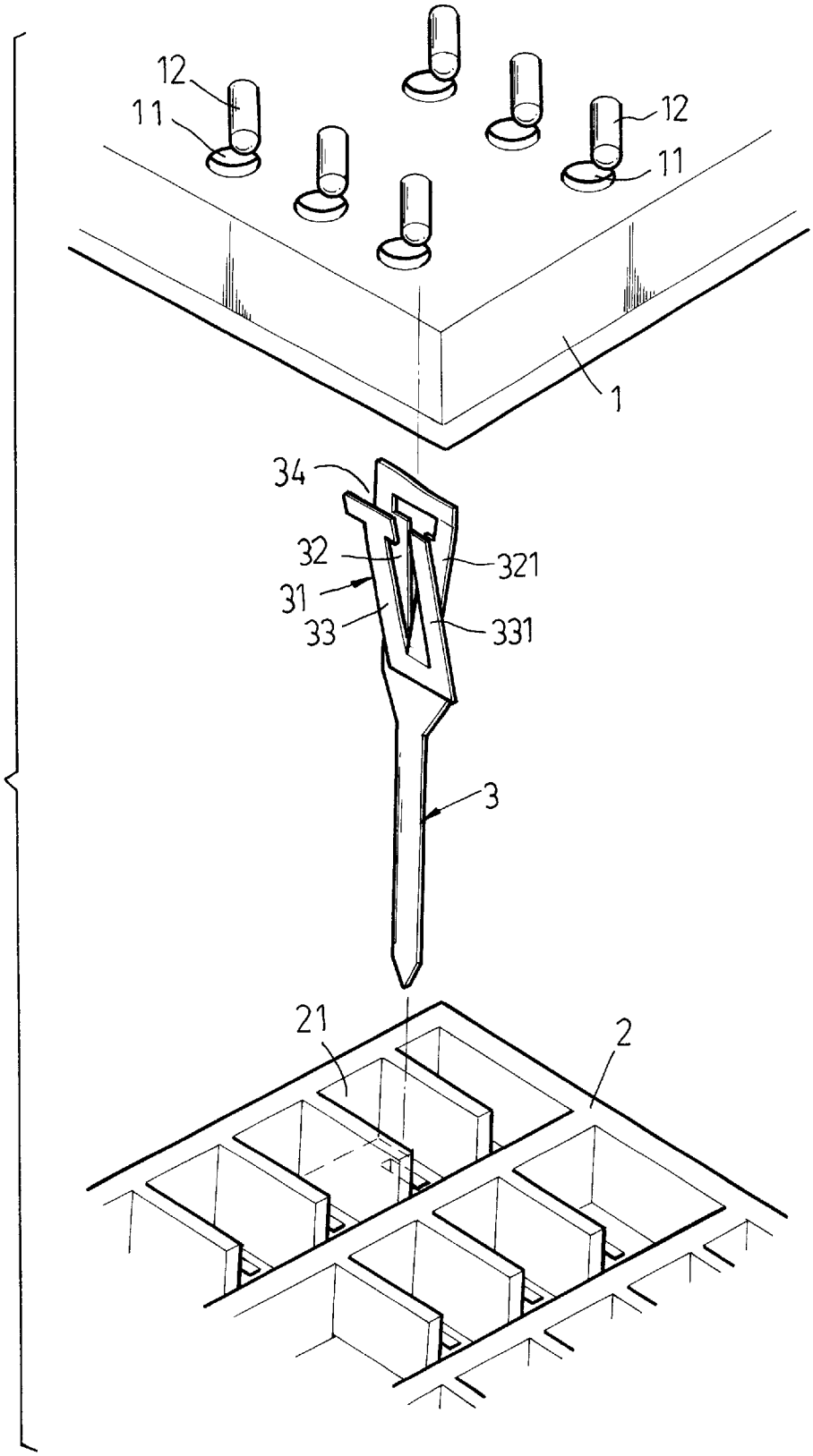
FIG. 2 is an exploded view in an enlarged scale of a part of the present invention.
Figure 3:
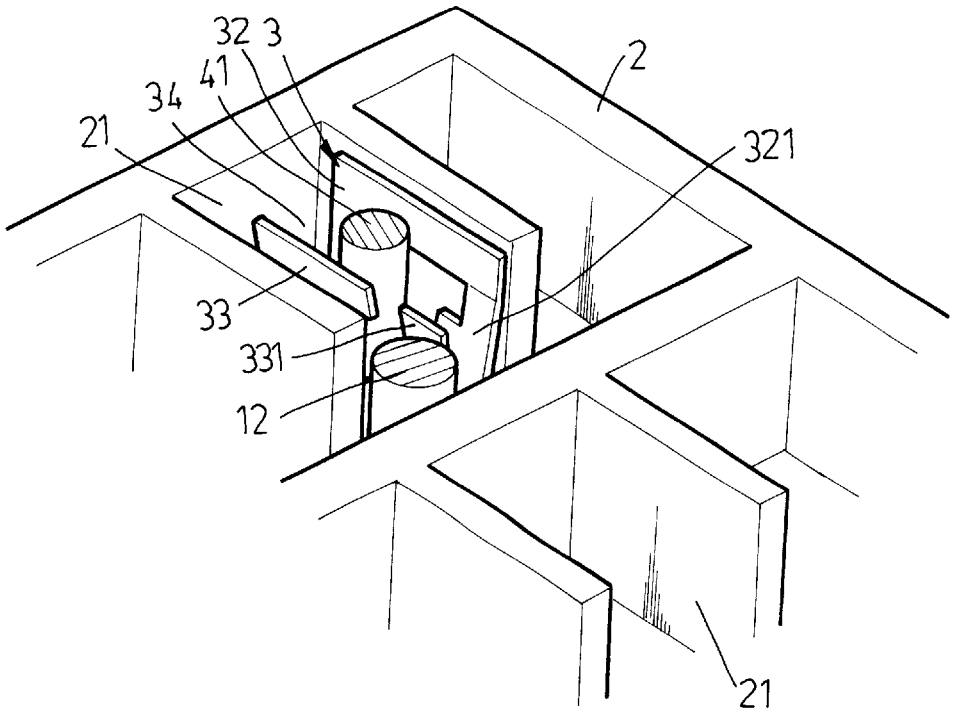
FIG. 3 is a cutaway view in an enlarged scale of a part of the present invention.

Referring to FIGS. 1 and 2, a zero insertion force CPU connector in accordance with the present invention comprises a sliding cover 1, a connector body 2, and a set of terminals 3. The sliding cover 1 is slidably covered on the connector body 2, having a plurality of insertion holes 11, and a plurality of bottom rods 12 respectively disposed adjacent to the insertion holes 11 and adapted to force the pins 41 of the CPU 4 into contact with the terminals 3. The connector body 2 comprises a plurality of terminal slots 21 disposed corresponding to the insertion holes 11 of the sliding cover 1, and adapted to receive the terminals 3.

Figure 4:
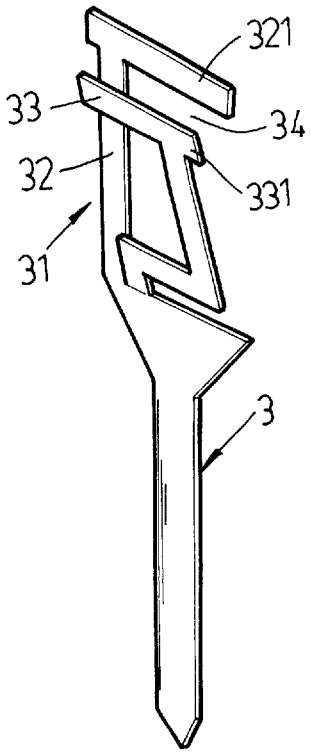
FIG. 4 is a perspective view of an alternate form of the terminal according to the present invention.
Figure 6:
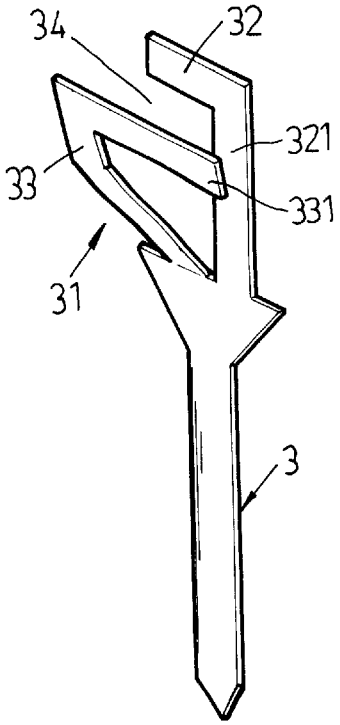
FIG. 6 is a perspective view of another alternate form of the terminal according to the present invention.

Referring to FIGS. 4 and 6 and FIG. 2 again, the terminals 3 are respectively positioned in the terminal slots 21 of the connector body 2, each comprising a head 31 disposed inside the corresponding terminal slot 21 and adapted to receive the corresponding pin 41 of the CPU 4. The head 31 comprises a supporting strip 32 and a springy pressure strip 33.The topside of the supporting strip 32 define with the springy pressure strip 33 a space 34. The springy pressure strip 33 has a bottom connecting portion 321 connected to the supporting strip 32. The springy pressure strip 33 further comprises an extension portion 331. After installation of the terminals 3 in the terminal slots 21 of the connector body 2, the bottom rods 12 of the sliding cover 1 are respectively disposed adjacent to the distal end of the extension portion 331 of each springy pressure strip 33.

Figure 5:
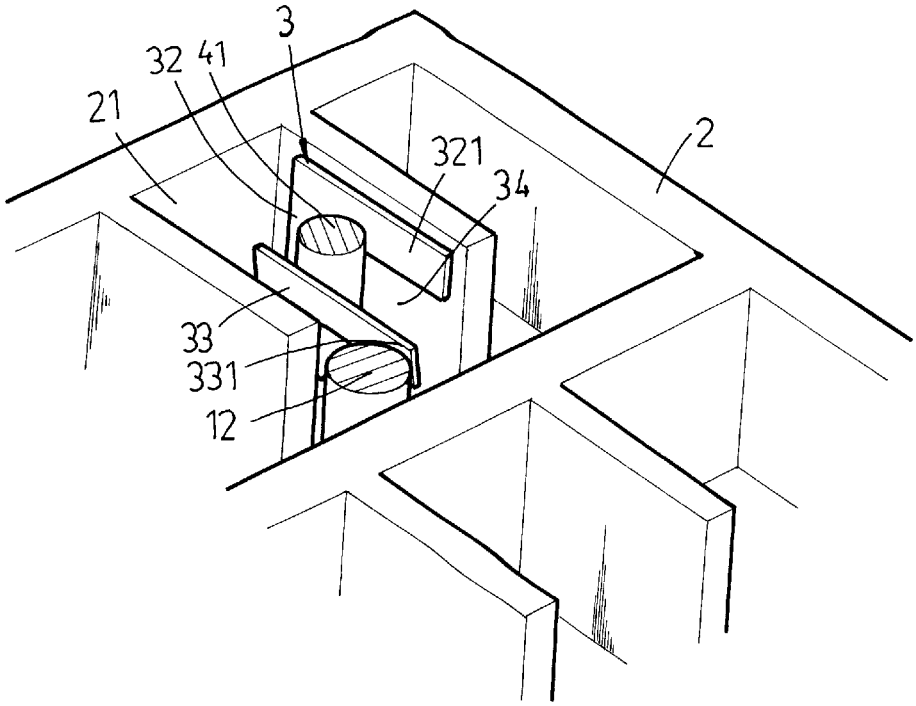
FIG. 5 is similar to FIG. 3 but showing the application of the terminal shown in FIG. 4.
Figure 7:
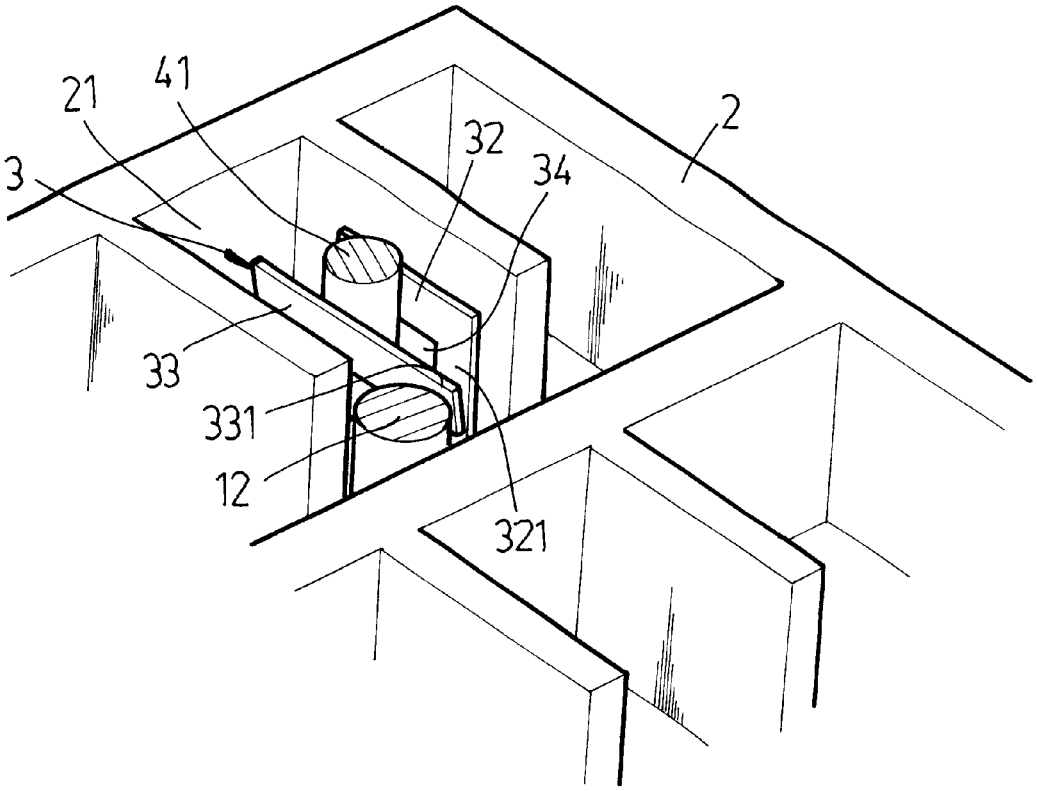
FIG. 7 is similar to FIG. 3 but showing the application of the terminal shown in FIG. 6.
Figure 8:
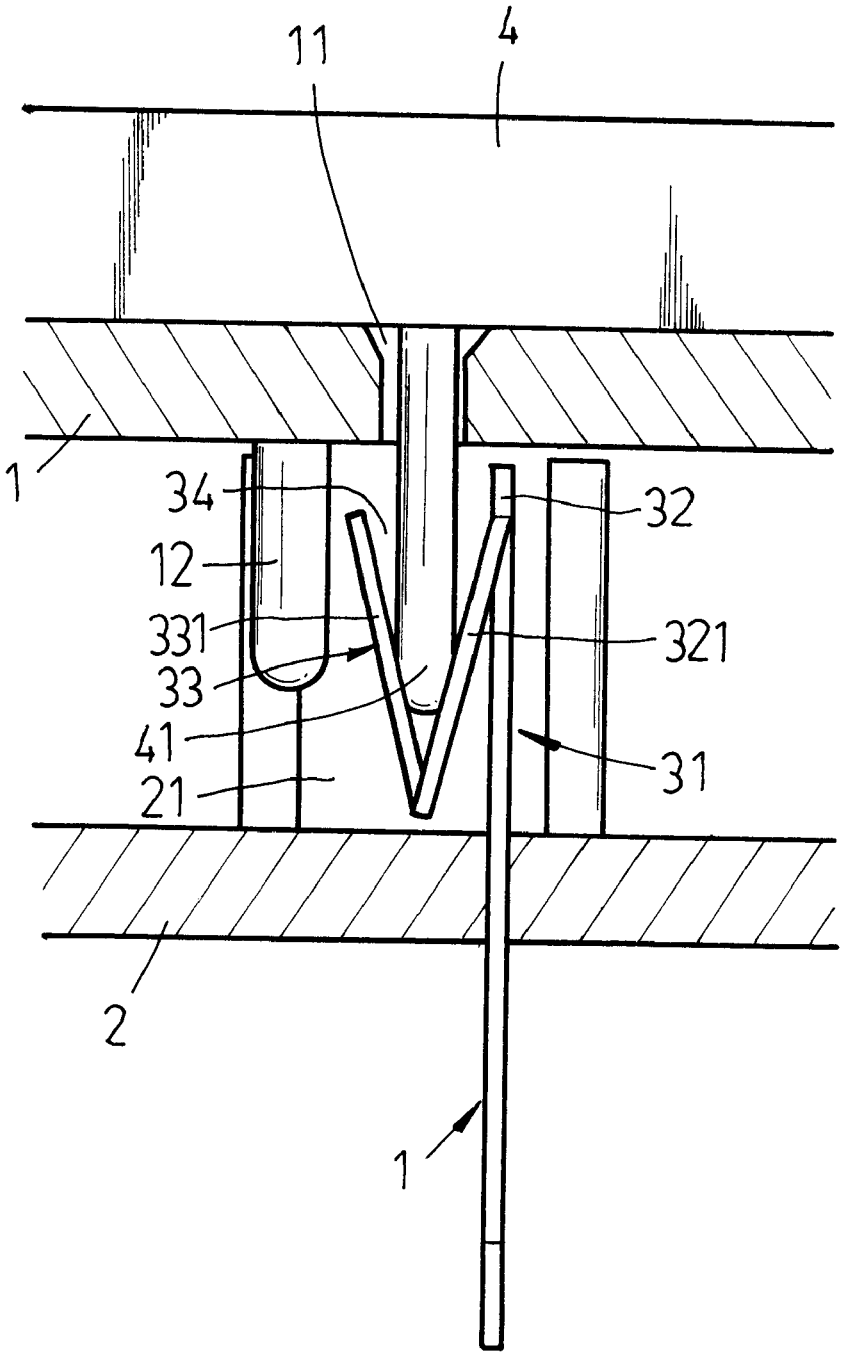
FIG. 8 is a sectional view showing the CPU installed in the CPU connector according to the present invention before locking of the sliding cover.
Figure 9:
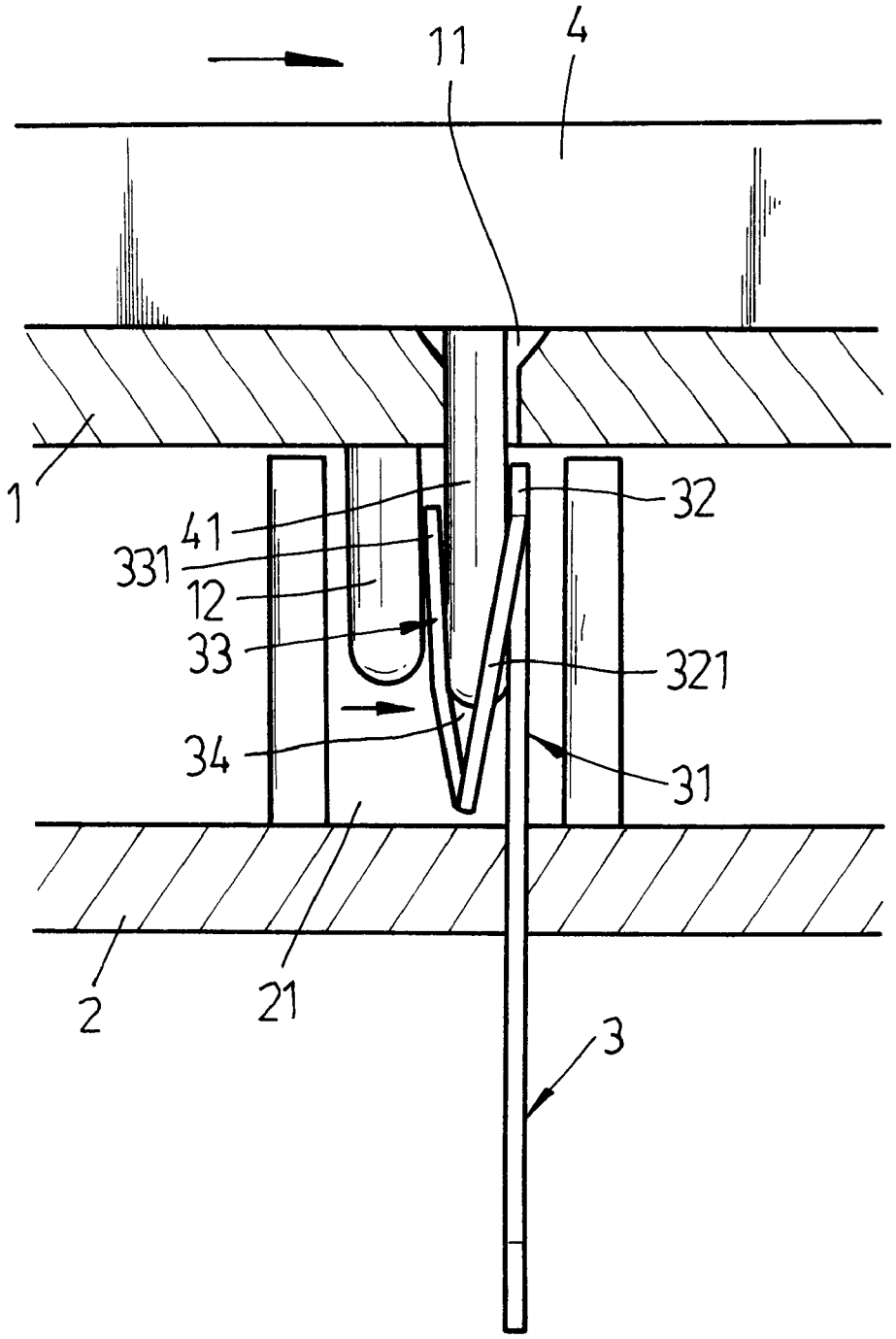
FIG. 9 is similar to FIG. 8 but showing the sliding cover shifted into position, the head of the terminal deformed and maintained in close contact with the corresponding pin of the CPU.
Figure 10:
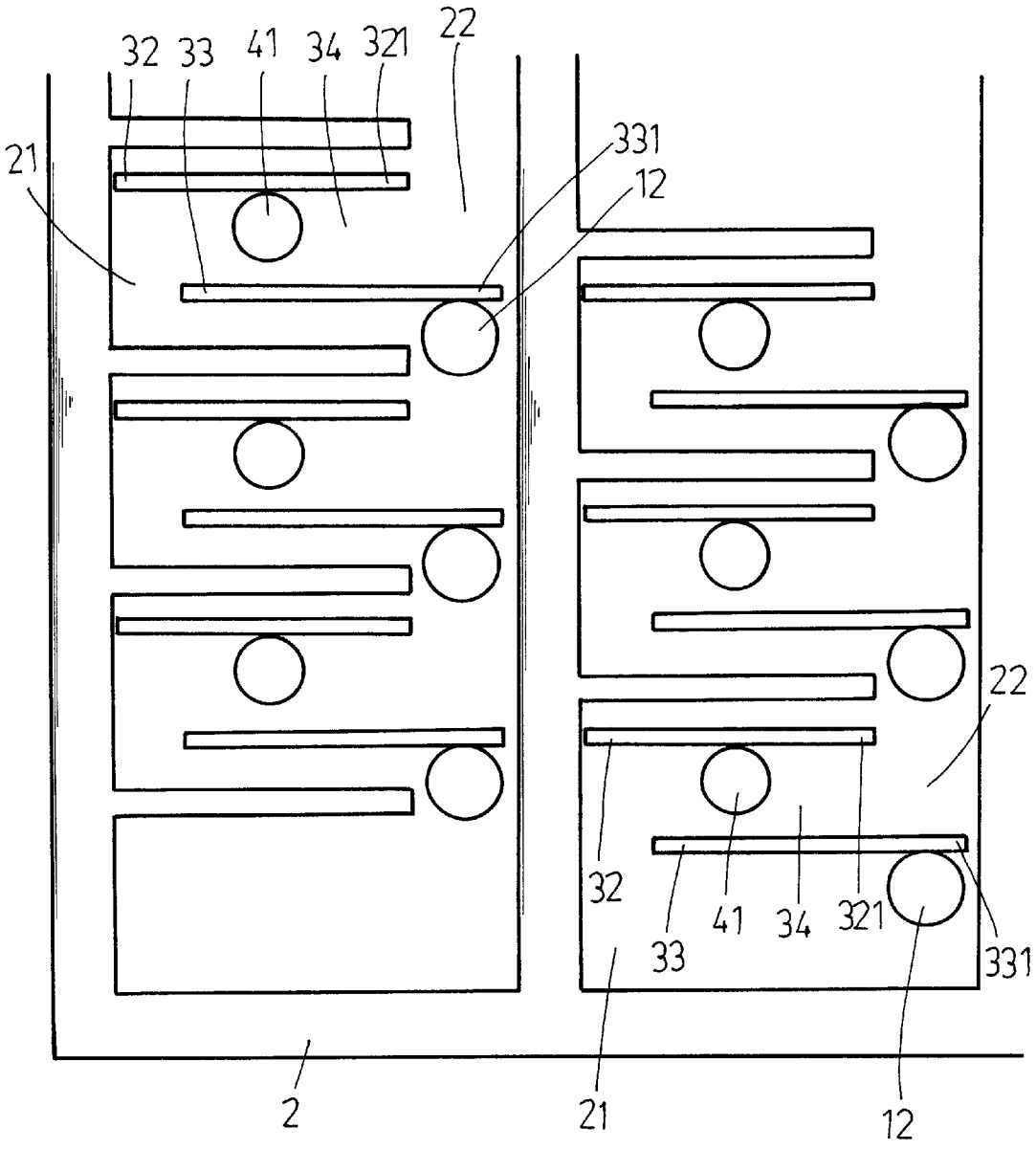
FIG. 10 is a top plain view showing the relation between the pins of the CPU and the terminals before locking of the sliding cover according to the present invention.
Figure 11:
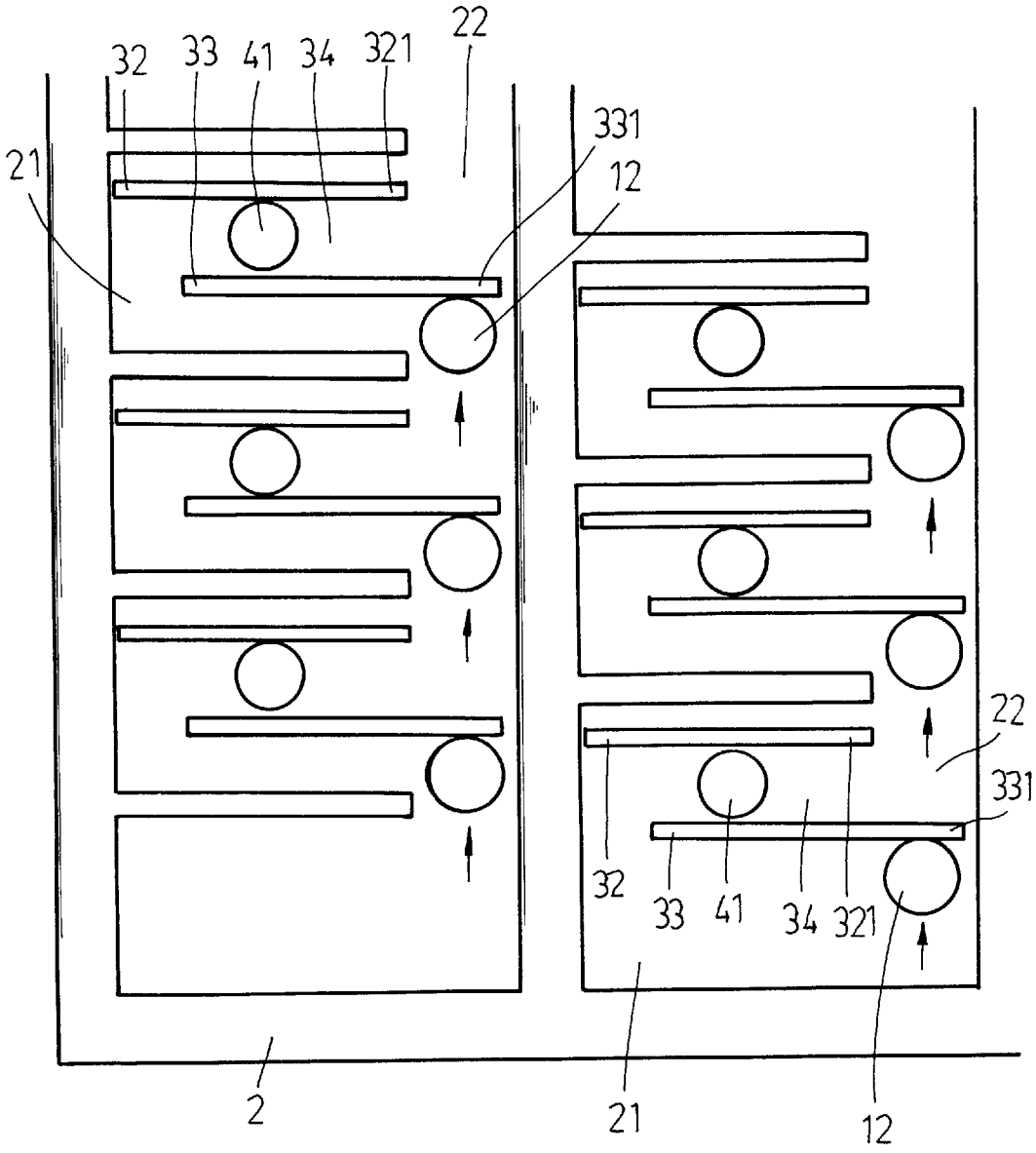
FIG. 11 is similar to FIG. 10 but showing the sliding cover shifted into position.
Figure 12:
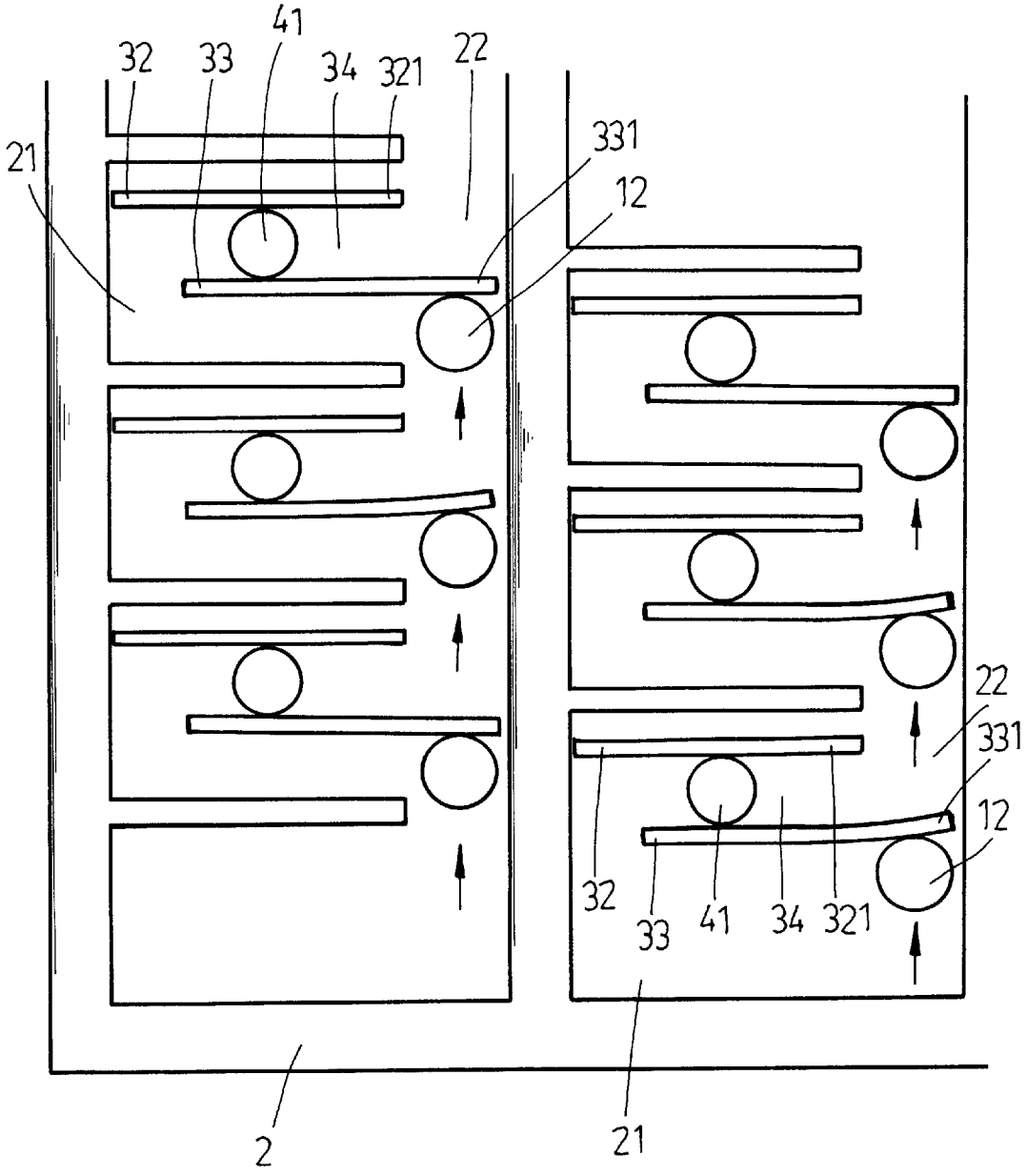
FIG. 12 is similar to FIG. 11 but showing the head of each terminal respectively held in close contact with the pins of the CPU.

Referring to FIGS. 5, 7 and 8 and FIG. 3 again, when inserting the pins 41 of the CPU 4 into the insertion holes 11 of the sliding cover 1, the pins 41 are respectively forced into the space 34 between the supporting strip 32 and springy pressure strip 33 of the head 31 of each terminal 3 without producing any insertion force. After installation of the CPU 4 in the sliding cover 1, the sliding cover 1 is shifted into position, thereby causing the bottom rods 12 of the sliding cover 1 to force the springy pressure strip 33 of each terminal 3 toward the respective supporting strip 32, and therefore the pins 41 of the CPU 4 are respectively retained in close contact between the supporting strip 32 and springy pressure strip 33 of the head 31 of each terminal 3.

Referring to FIGS. from 10 through 13, the terminal slots 21 of the connector body 2 each have a side opening 22 for the passing of the bottom rods 12 of the sliding cover 1. Because the pressure strip 33 of each terminal 3 is springy, the pressure strips 33 of the terminals 3 can be respectively temporarily deformed at different extent when shifting the sliding cover 1 into position, enabling the head 31 of each terminal 3 to be respectively forced into close contact with the pins 41 of the CPU 4 without causing damage to the terminals 3.

It is to be understood that the drawings are designed for purposes of illustration only, and are not intended for use as a definition of the limits and scope of the invention disclosed.

What the invention claimed is:

1. A zero insertion force CPU connector comprising a connector body, said connector body having a plurality of terminal slots, a plurality of terminals respectively installed in said terminal slots, said terminals each having a head received inside said terminal slots and adapted to receive the pins of a CPU, and a sliding cover covered on said connector body an d adapted to support a CPU and carry the CPU into contact with said terminals, said sliding cover having a plurality of insertion holes corresponding to the terminal slots of said connector body f or receiving the pins of the CPU put thereon, wherein the head of each of said terminals comprises a supporting strip, a springy pressure strip, and a space defined between said supporting strip and said springy pressure strip and adapted to receive one pin of the CPU carried on said sliding cover; said sliding cover comprises a plurality of bottom rods adapted to force the springy pressure strip of each of said terminals toward the supporting strip of each of said terminals, enabling the pins of the loaded CPU to be respectively maintained in contact between the supporting strip and springy pressure strip of the head of each of said terminals.

2. The zero insertion force CPU connector of claim 1 wherein the springy pressure strip of the head of each of said terminals has a bottom end connected to the respective supporting strip.

3. The zero insertion force CPU connector of claim 1 wherein the head of each of said terminals further comprises a connecting portion connected between a bottom end of the respective springy pressure strip and a part of the respective supporting strip.

4. The zero insertion force CPU connector of claim 1 wherein the springy pressure strip of each of said terminals has an extension portion adapted to receive pressure from the corresponding bottom rod of said sliding cover.

5. The zero insertion force CPU connector of claim 1 wherein the terminal slots of said connector body each have a side opening for the passing of the bottom rods of said sliding cover respectively.

* * * * *